US007305915B2

(12) United States Patent
Gray, Jr.

(10) Patent No.: US 7,305,915 B2
(45) Date of Patent: Dec. 11, 2007

(54) EFFICIENT PUMP/MOTOR WITH REDUCED ENERGY LOSS

(75) Inventor: Charles L. Gray, Jr., Pinckney, MI (US)

(73) Assignee: The United States of America as represented by the Administrator of the Environmental Protection Agency, Washington, DC (US)

( * ) Notice: Subject to any disclaimer, the term of this patent is extended or adjusted under 35 U.S.C. 154(b) by 67 days.

(21) Appl. No.: 10/795,797

(22) Filed: Mar. 8, 2004

(65) Prior Publication Data

US 2005/0193888 A1 Sep. 8, 2005

(51) Int. Cl.
*F01B 1/02* (2006.01)

(52) U.S. Cl. ..... 92/12.2; 92/57

(58) Field of Classification Search ..... 91/486, 91/197, 485, 499–507; 92/12.2, 57; 60/464, 60/475, 476, 489; 417/269
See application file for complete search history.

(56) References Cited

U.S. PATENT DOCUMENTS

| | | | | | |
|---|---|---|---|---|---|
| 2,525,979 | A * | 10/1950 | Vickers | 91/486 |
| 2,661,701 | A * | 12/1953 | Ferris | 91/506 |
| 2,931,250 | A * | 4/1960 | Ebert | 477/69 |
| 3,382,813 | A * | 5/1968 | Schauer | 91/506 |
| 3,862,588 | A * | 1/1975 | Bahrle et al. | 91/486 |
| 4,034,650 | A * | 7/1977 | Molly | 91/485 |
| 4,271,725 | A | 6/1981 | Takao et al. | 74/730 |
| 4,893,549 | A | 1/1990 | Forster | 92/12.2 |
| 4,991,492 | A | 2/1991 | Bratt et al. | 92/12.2 |
| 5,182,978 | A | 2/1993 | Akasaka et al. | 91/499 |
| 5,488,894 | A | 2/1996 | Schröder | 91/505 |
| 6,203,283 | B1 * | 3/2001 | Fleming et al. | 91/504 |
| 6,505,541 | B2 * | 1/2003 | Skirde et al. | 92/12.2 |
| 2004/0173089 | A1 | 9/2004 | Gray, Jr. et al. | 91/505 |
| 2005/0120873 | A1 | 6/2005 | Gray, Jr. | 91/418 |
| 2005/0163639 | A1 | 7/2005 | Gray, Jr. | 417/572 |

FOREIGN PATENT DOCUMENTS

| | | |
|---|---|---|
| FR | 2.067.811 | 8/1971 |
| GB | 1053602 | 1/1967 |

* cited by examiner

*Primary Examiner*—Igor Kershteyn
(74) *Attorney, Agent, or Firm*—Seed IP Law Group, PLLC

(57) ABSTRACT

A bent axis pump/motor includes a back plate positioned within a casing, and a check valve positioned in the back-plate, the check valve configured to control passage of fluid from within the casing to an interior of the back plate. A yoke, coupled to the back plate, includes trunnions, positioned within respective apertures in the casing, upon which the yoke rotates. Bearings, occupying less than the complete circumference of the respective trunnion, are positioned between each of the trunnions and respective inner walls of the apertures. Trunnion apertures, for passage of fluid, are positioned in a portion of the circumference not occupied by the respective bearing. A valve positioned within the casing selectively couples high- and low-pressure fluid to the trunnions. Fluid supply channels, formed integrally with the casing, transmit fluid from the valve to the trunnions via fluid apertures provided within the apertures in the casing.

32 Claims, 9 Drawing Sheets

EFFICIENT PUMP/MOTOR WITH REDUCED ENERGY LOSS

BACKGROUND OF THE INVENTION

1. Field of the Invention

This disclosure relates generally to improvements of various components and systems commonly found in bent-axis pump/motors.

2. Description of the Related Art

Bent-axis pump/motors provide a high degree of efficiency in converting energy supplied as a pressurized fluid, from a hydraulic accumulator, or some other pressurized fluid source, into kinetic energy. Additionally, bent-axis pump/motors provide a further advantage over many other hydraulic technologies, inasmuch as bent-axis pump/motors operate equally well as pumps or motors, providing the potential, in automotive applications, of reclaiming and storing kinetic energy during braking, for use during a subsequent acceleration.

FIG. 1 shows a simplified diagrammatical representation of a hydraulic pump/motor system 100. The system 100 comprises a bent-axis pump/motor 102, which includes a casing 125, a yoke 118 and a cylinder barrel 104.

The cylinder barrel 104 has piston cylinders 106 radially spaced around a common center. The barrel 104 is configured to rotate around an axis A. Each of the cylinders 106 includes a piston 108 having a first end 110 positioned within the cylinder 106, and configured such that there is a pressure tight seal between the first end 110 of the piston 108 and the wall of the respective cylinder 106. A second end 112 of each of the pistons 106 engages a drive plate 114, which is coupled to an input/output shaft 116 of the pump/motor 102.

The angle of the barrel 104 relative to the drive plate 114 dictates the displacement volume of the pump/motor 102 and hence the amount of energy converted by the pump/motor 102.

The angle of the barrel 104 is controlled by the yoke 118, which includes a back plate 119 to which the barrel 104 is rotatably coupled. The yoke 118 further includes a pair of trunnions 120, 121 upon which the yoke 118 rotates, around an axis B. The trunnions 120, 121 are received by apertures 122, 123 in the pump/motor casing 125, and their rotation is accommodated by bearings 126, 127 that are positioned within the apertures 122, 123 of the casing 125, and which encircle the trunnions 120, 122, respectively. As the yoke 118 rotates around axis B, so also does the barrel 104, thereby changing the barrel angle relative to the drive plate 114.

Fluid channels 128, 129 are coupled from the yoke 118, via a valve plate surface 130 of the back plate 119, to each of the cylinders 106 of the barrel 104, as the barrel 104 rotates over the valve plate 130. The fluid channels 128, 129 run down respective arms 132, 133 of the yoke 118 to the trunnions 120, 121. The channels 128, 129 within the yoke 118 terminate at the trunnions 120, 121 at respective ports 134, 135 that are positioned to couple with corresponding fluid ports 136, 137 within the pump/motor casing 125.

The fluid ports 136, 137 of the pump/motor casing 125 are each coupled to low- and high-pressure fluid sources 138, 140, via respective switching valves 142, 143 configured to selectively couple the low-pressure source 138 to one side of the pump/motor 102 via the arm 132 of the yoke 118 and the high-pressure source 140 to the other side of the pump/motor 102 via the other arm 133, or alternatively, to reverse this arrangement. In this way, the device can be selectively configured to apply rotational force to the output shaft 116 in a clockwise or counter-clockwise direction. The coupling between the valves 142, 143 and the fluid ports 136, 137 of the pump/motor casing 125 is generally accomplished using respective pressure hoses 144, 145.

The casing 125 encloses the moving parts of the pump/motor 102. In some systems, the space 117 within the casing 125 is filled with hydraulic fluid and may be in fluid communication with the low-pressure fluid source 138 via a high volume, low loss fluid connection such as a large-bore pressure hose (not shown). This connection maintains the fluid in the casing 125 at a pressure substantially equal to the pressure at the low-pressure fluid source 138. Accordingly, the pump/motor casing 125 may be manufactured to withstand the pressure of the low-pressure fluid source 138. This pressure may be on the order of 100 to 300 psi.

In operation, for example, in an application in which the pump/motor system 100 is coupled to the drive train of a vehicle, fluid from the high-pressure source 140 is coupled to fluid port 137 of the pump/motor 102 by valve 143. The other fluid port 136 is simultaneously coupled to the low-pressure fluid source 138 by the other valve 142. High-pressure fluid enters the pump/motor 124 via the fluid port 137, passes from trunnion 121, through the channel 129, to the valve plate 130 and into the cylinders 106, as the barrel 104 rotates over the valve plate 130. The pistons 108 are sequentially driven against the drive plate 114, causing the drive plate 114 to rotate around a "bent" axis A to achieve displacement. As the barrel 104 also rotates around axis A, the fluid in the cylinders 106 is sequentially released through the valve plate 130 and into the channel 128, to be vented back through the valve 142 to the low-pressure fluid source 138. In this manner, energy from the high-pressure source 140 is converted to kinetic energy by the pump/motor 102 to be transmitted via the rotating shaft 116 to the drive train of the vehicle or other mechanical system.

To slow the vehicle or other mechanical system, the high- and low-pressure connections are reversed, such that the low-pressure source 138 is coupled by the valve 143 to the port 137, while the high-pressure source 140 is coupled by the valve 142 to the port 136. Such a configuration, with the pump/motor 102 at rest, would cause the shaft 116 to rotate in the opposite direction. However, inasmuch as the shaft 116 is coupled to the drive train of the vehicle, the shaft 116 is driven, by the forward momentum of the vehicle, to rotate in the forward direction. Because the pressure connections have been reversed on the pump/motor 102, the pump/motor is now resisting the rotation of the shaft 116. As a result, the vehicle is slowed and, at the same time, fluid is drawn from the low-pressure side of the circuit and forced into the high-pressure fluid source 138, the pump/motor 102 functioning as a pump to store energy to be used subsequently. This is commonly referred to as regenerative braking.

If the vehicle is traveling in reverse mode, the sequence of operation will be opposite that previously described. However, the results will remain the same, namely, high-pressure fluid at the port 136 will drive the vehicle in reverse, while reversing the connection and placing high pressure at port 137 will slow the vehicle as it travels in reverse.

A pump/motor and its operation are described in much greater detail in U.S. patent application Ser. No. 10/379,992, entitled HIGH-EFFICIENCY, LARGE ANGLE, VARIABLE DISPLACEMENT HYDRAULIC PUMP/MOTOR, which is incorporated herein by reference, in its entirety. This application will provide additional background on the features and operation of a bent-axis pump/motor.

BRIEF SUMMARY OF THE INVENTION

According to an embodiment of the invention, a bent axis pump/motor is provided, including a casing configured to be substantially filled with fluid, a back plate positioned within the casing and configured to receive or include a valve plate, and a check valve positioned in the back-plate and configured to permit passage of fluid from within the casing and outside of the back plate through the check valve to an interior of the back plate. The check valve is further configured to restrict flow of fluid from the interior of the back plate through the check valve.

According to another embodiment, the casing of the pump/motor comprises first and second apertures positioned coaxially on opposite sides of the casing and traversing from the interior of the casing to the exterior thereof. The pump motor further comprises a yoke coupled to the back plate. The yoke includes first and second trunnions positioned within the first and second apertures, respectively, and the yoke is configured to rotate on the trunnions around an axis. First and second bearings are positioned between the first and second trunnions and an inner wall of each of the first and second apertures, respectively, the position of each of the first and second bearings further defined by respective inner and outer planes, parallel to each other and transverse to the axis, with the respective bearing positioned therebetween. Each of the first and second bearings occupies less than the complete circumference of the respective trunnion. Each of the trunnions includes a respective aperture for passage of fluid therethrough, positioned between the inner and outer planes in a portion of the circumference not occupied by the bearing.

According to an additional embodiment, the pump/motor includes first and second fluid supply channels formed integrally with the casing. The supply channels are configured to transmit fluid from valves or other fluid switching means to the first and second trunnions via apertures provided within the first and second apertures and positioned and configured to couple with the apertures provided in the trunnions.

A further embodiment of the invention provides a valve positioned within the casing and configured to selectively couple high- and low-pressure fluid supplies to the first and second trunnions, via the first and second fluid supply channels.

According to an embodiment of the invention, a yoke configured to carry a rotatable barrel is provided, a trunnion coupled to the yoke and configured to be received by an aperture of a pump casing, and further configured to receive a bearing between the trunnion and a wall of the aperture in a position defined by two parallel planes transverse to an axis of the trunnion, and a fluid channel passing within the yoke to the trunnion and exiting the trunnion via an aperture positioned between the two planes.

According to an additional embodiment, a pump/motor is provided, having a casing configured to receive components of the pump/motor, a valve configured to selectively control fluid flow, the valve including a valve body, integral to the casing; and a first fluid channel, integral to the frame, having a first terminus at the valve and a second terminus at a first fluid port configured to transmit fluid to a first trunnion of the pump/motor. The pump/motor may also include a second fluid channel, integral to the frame, having a first terminus at the valve and a second terminus at a second fluid port configured to transmit fluid to a second trunnion of the pump/motor.

DETAILED DESCRIPTION OF THE INVENTION

Figure 1:
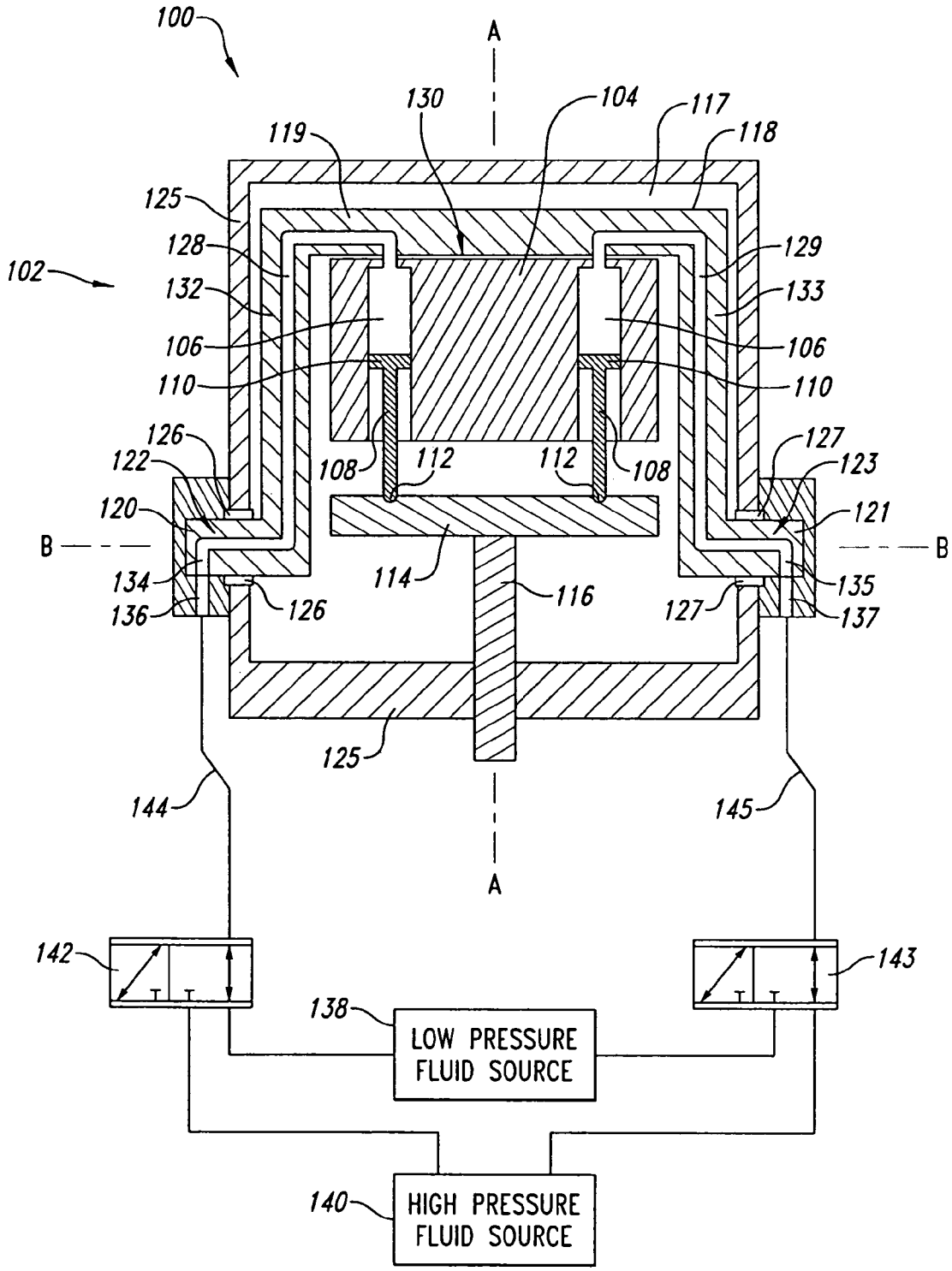
FIG. 1 (Prior Art)
FIG. 1 is a diagrammatical representation of a pump/motor according to known art.

The improvements described below with reference to various embodiments of the invention deal generally with minimizing losses occurring in the various channels, couplings, valves, and components of a hydraulic pump/motor system. For example, any time a hydraulic fluid is obliged to change directions within a conduit, energy is lost. When the directional changes are very sharp, or occur in restricted passages, the energy loss is exacerbated. In pump/motors according to current technology, such losses occur in locations such as hose couplings, valve passages, and the passages through the yoke trunnions.

These energy losses are expressed as a difference in pressure between the high-pressure fluid source, or accumulator, and the high-pressure present at the valve plate of the pump/motor, and between the low-pressure fluid source, or accumulator, and the low-pressure present at the valve plate of the pump/motor. The actual power available to the motor is directly proportionate to the difference between the high-pressure and low-pressure found at the valve plate. When pressure losses are reduced between the motor and the accumulators, the pressure difference at the valve plate is increased, and thus the available power to the motor is increased.

In the various embodiments of the invention illustrated in FIGS. 2-6, sources of high- and low-pressure fluid are not shown. Such fluid sources are well known in the art. A common type of pressurized fluid storage is an accumulator, which is referred to occasionally in the present descriptions, and is well understood in the art. Other types of fluid supply and storage may be employed and are considered to fall within the scope of the invention.

As previously explained, during a regenerative braking operation a pump/motor is configured to operate as a pump, forcing fluid at high pressure into the high-pressure source, and drawing fluid from the low-pressure source. For example, given the pump/motor and conditions previously described with reference to FIG. 1, with the vehicle traveling in a forward direction, the pump/motor 102 draws low-pressure fluid from port 137 during braking and pumps high-pressure fluid to port 136. There is an energy loss associated with the passage of the low-pressure fluid through the pressure lines, channels, trunnion, and valves between the valve plate 130 and the low-pressure fluid source 138, or accumulator 140.

Figure 2:
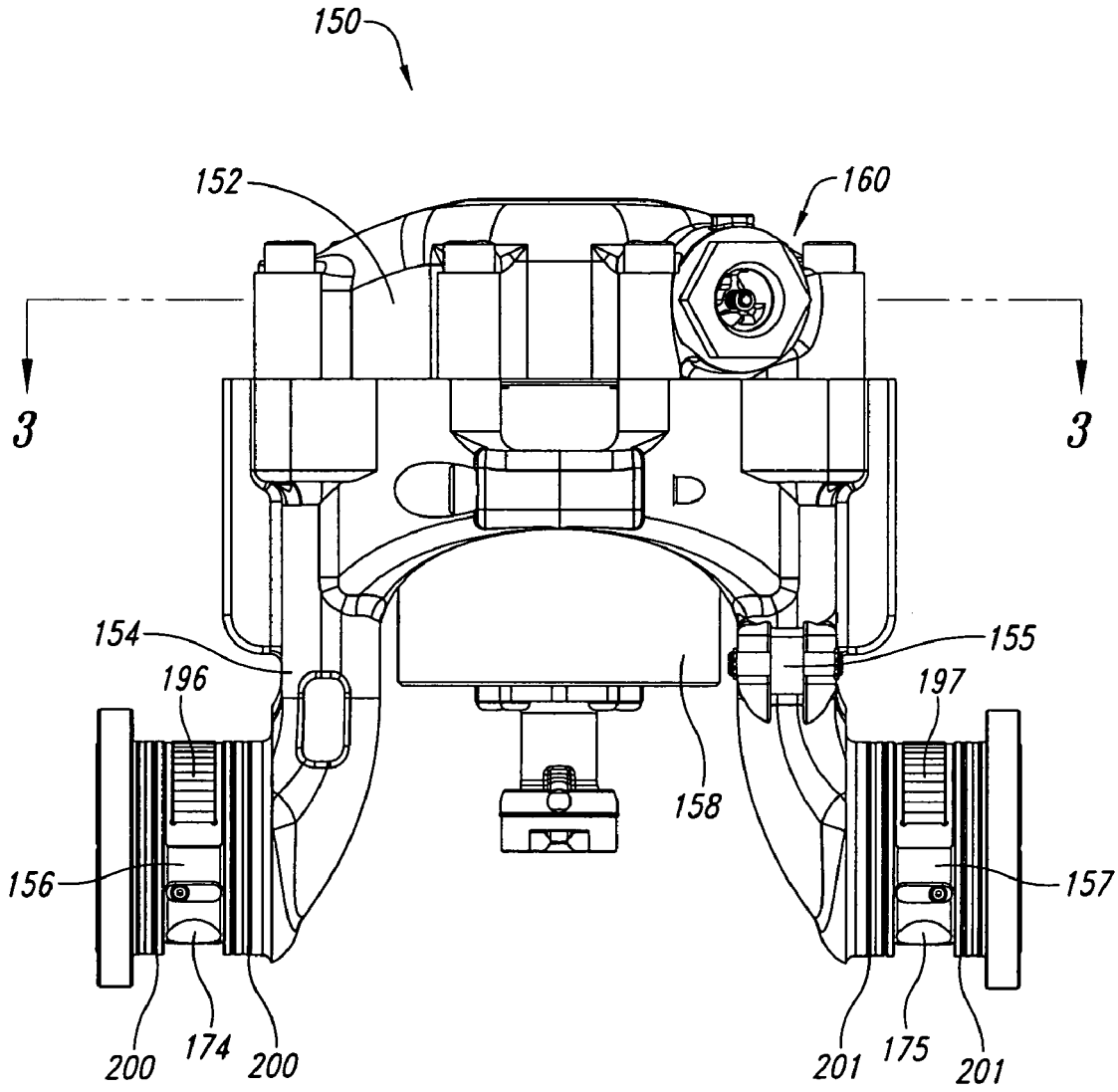
FIG. 2 is an elevation of a yoke of a pump motor according to an embodiment of the invention.
Figure 4:
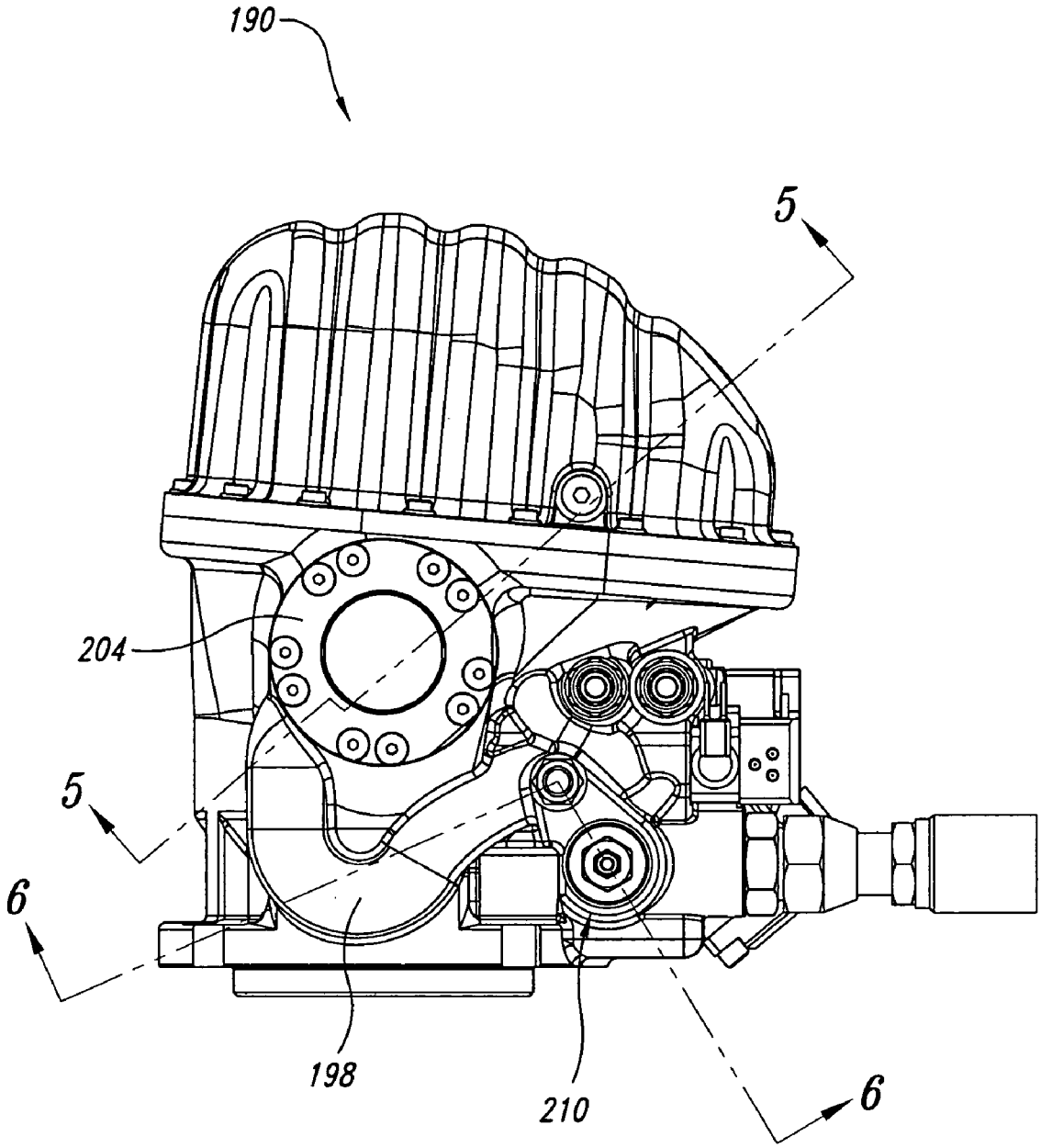
FIG. 4 is a side elevation of a pump/motor according to an embodiment of the invention.
Figure 5A:
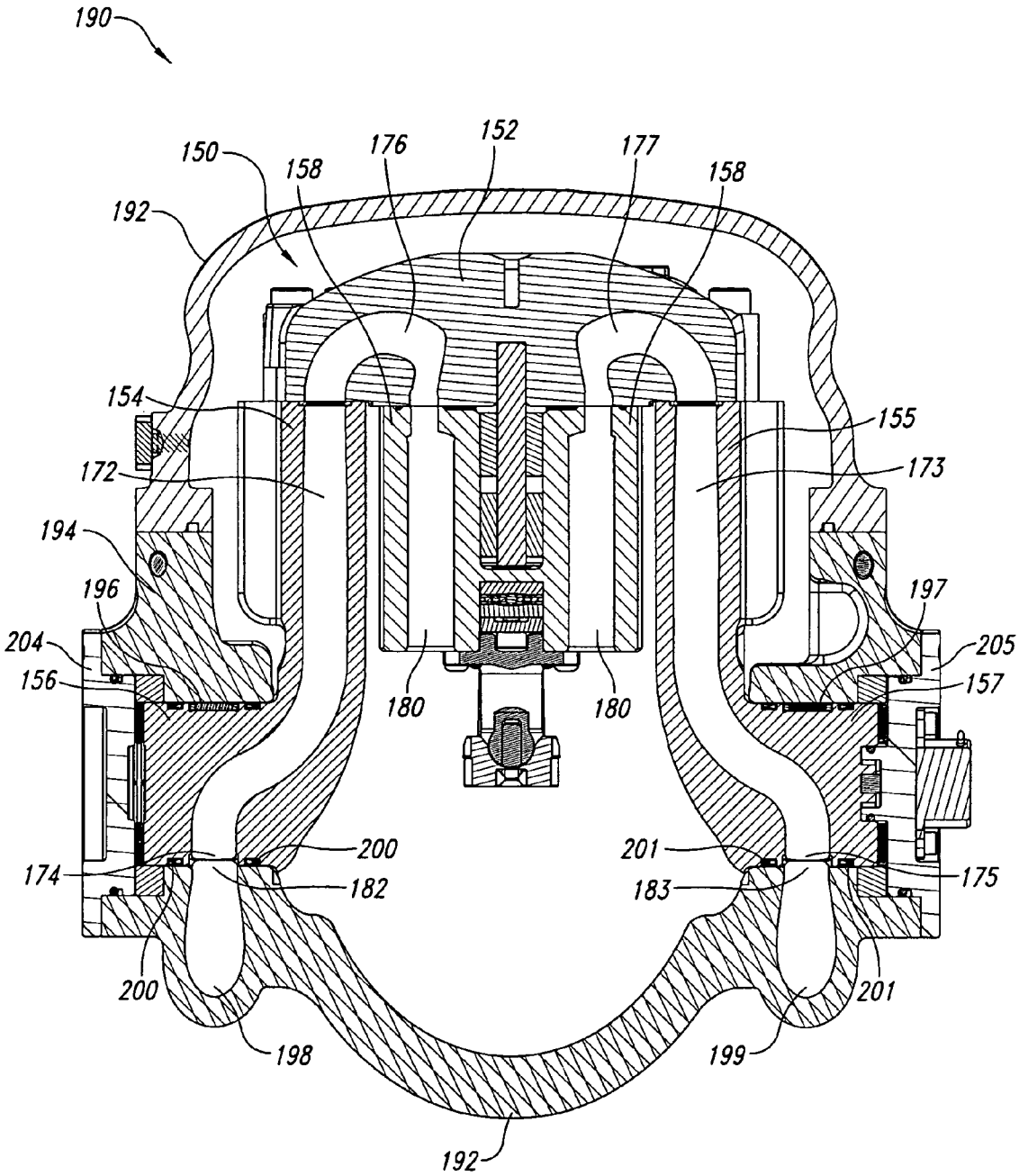
FIG. 5A is a cross section of the pump/motor of FIG. 4, taken along line 5-5.
Figure 5B:
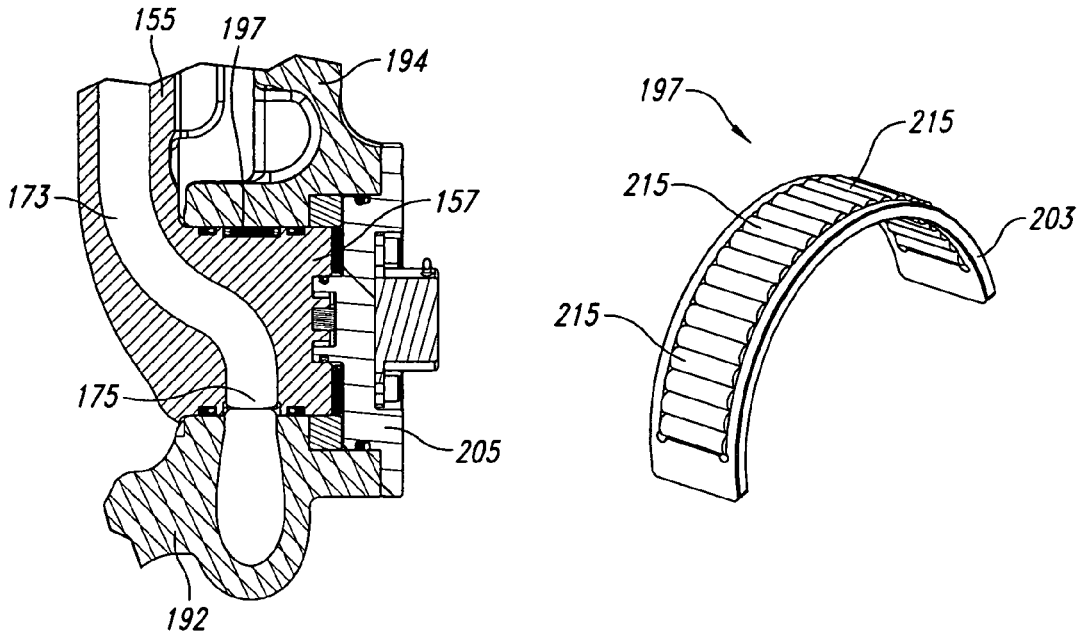
FIGS. 5B-5D are details of the pump/motor of FIG. 5A, according to various embodiments of the invention.
Figure 5C:
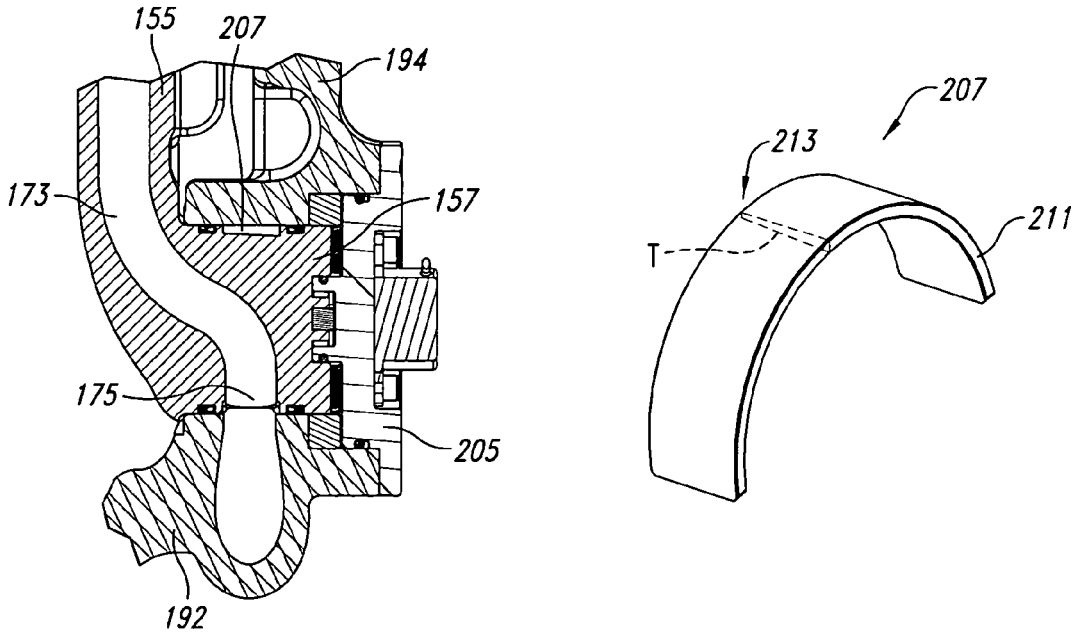
Figure 5D:
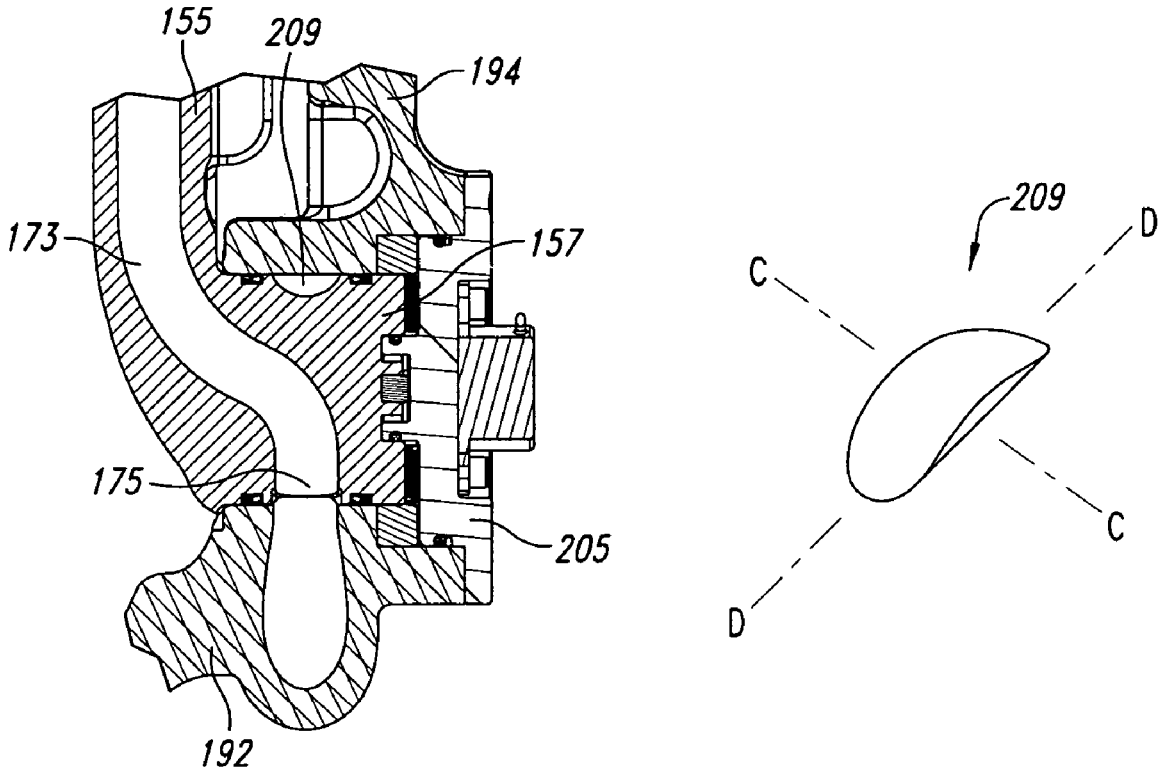
Figure 6:
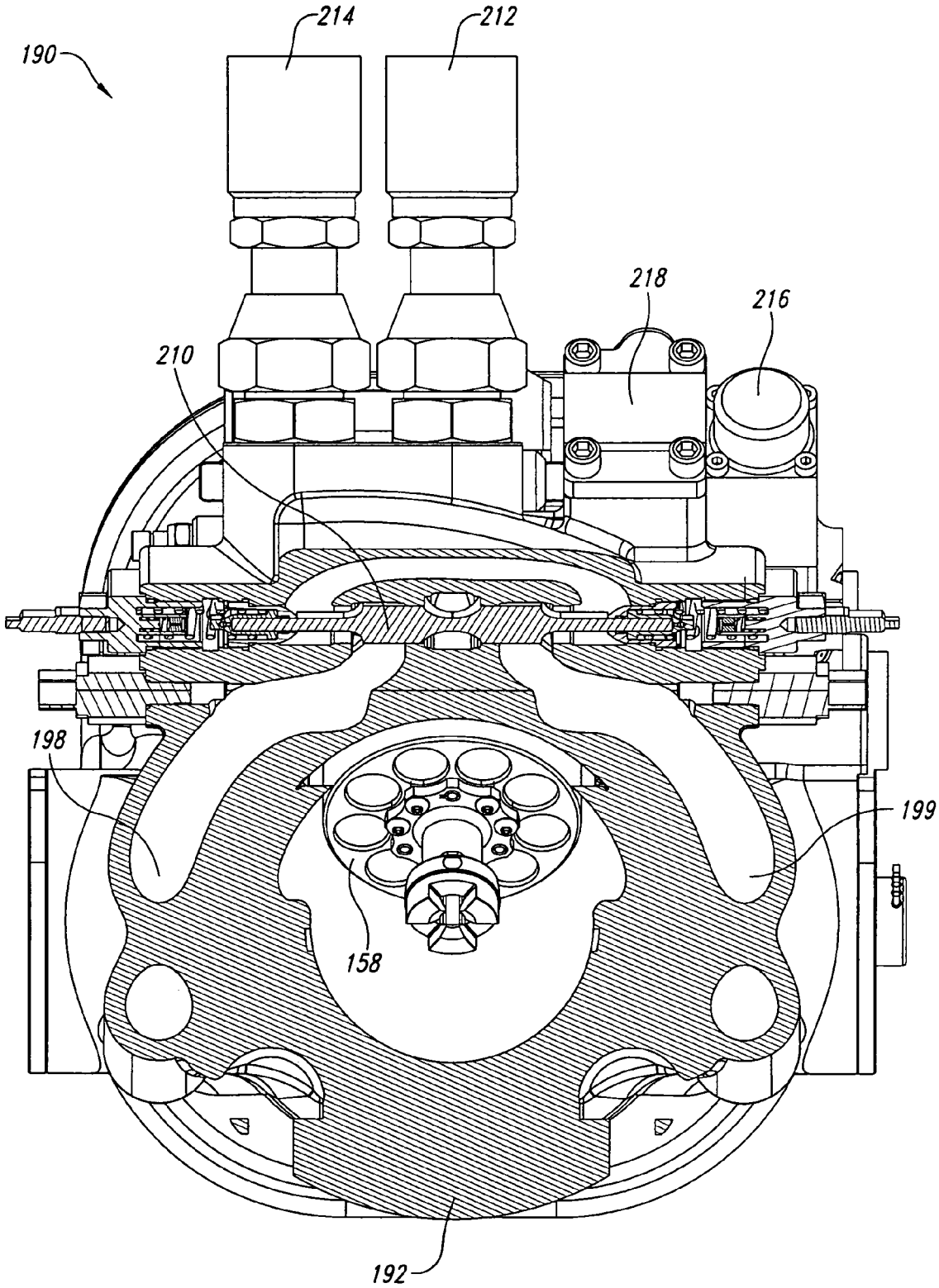
FIG. 6 is a cross section of the pump/motor of FIG. 4, taken along line 6-6.

FIG. 2 shows a yoke 150 of a pump/motor 190 (the pump/motor 190 is shown in FIGS. 4-6). As shown in FIGS. 2 and 5A the yoke 150 of pump/motor 190 includes a back plate 152, arms 154, 155, and trunnions 156, 157. The yoke 150 also includes check valves 160 in the back plate 152, which will be described in detail hereafter.

Figure 3A:
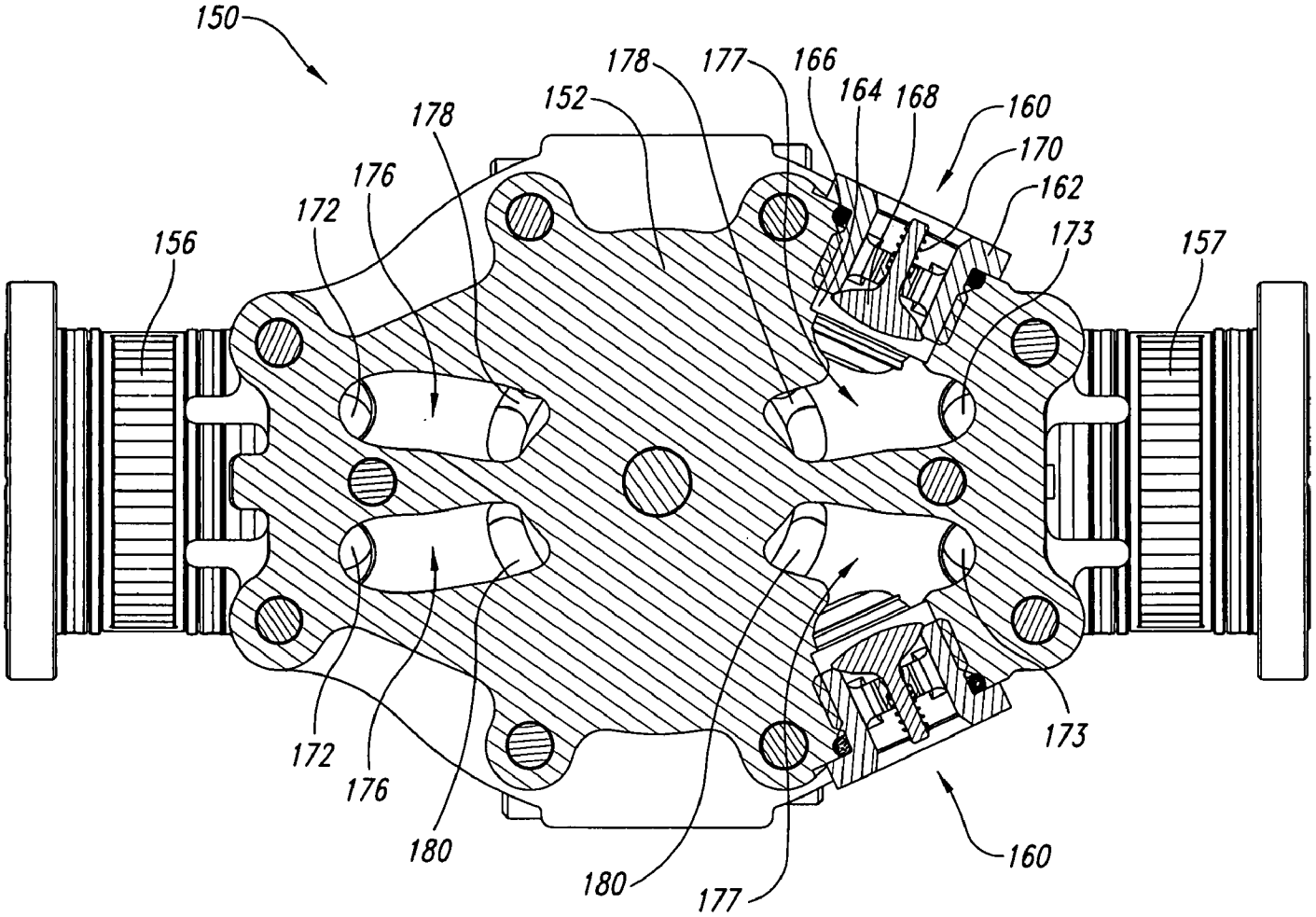
FIG. 3A is a cross section of the yoke of FIG. 2, taken along line 3-3.
Figure 3B:
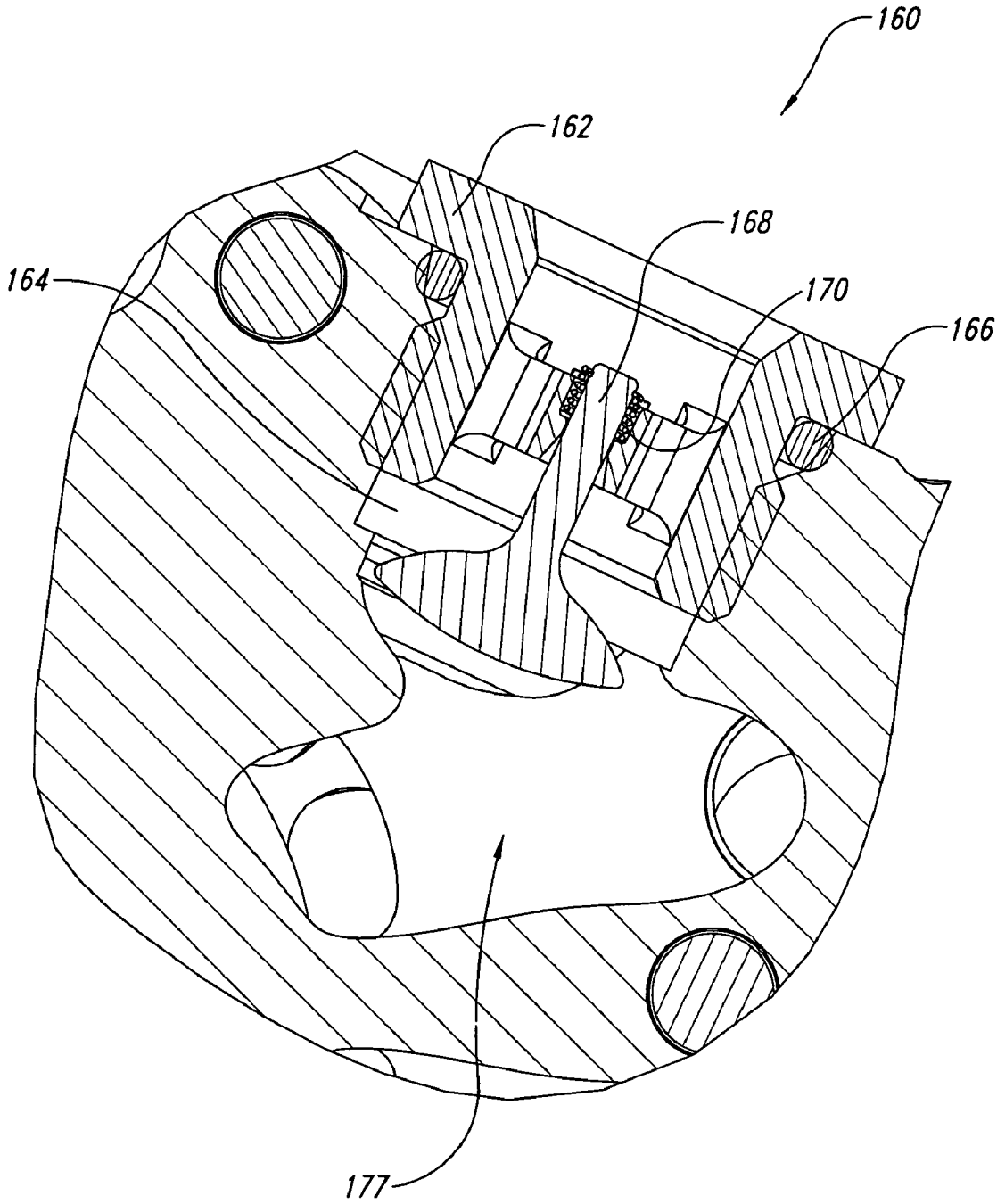
FIG. 3B is a detail of a check valve of the type illustrated in the sectional view of FIG. 3A.

As seen in FIG. 3A, a cross-section of the back plate 152 is shown, including details of the check valve 160. An enlarged view of a check valve 160 is shown in FIG. 3B. More particularly, the check valve 160 of this embodiment includes a threaded insert 162 configured to engage a threaded aperture 164 in the back plate 152. Seal 166 provides a fluid seal between the insert 162 and the back plate 152. Poppet valve 168 is biased in a closed position by spring 170.

The yoke 150 further includes fluid channels 172, 173 located within the arms 154, 155. It may be seen, in FIG. 3A, that there are two fluid channels 172 within the arm 154, and two fluid channels 173 within the arm 155. The provision of two fluid channels 172, 173 in each of the arms 154, 155 enhances the stiffness of the arms 154, 155 as compared with arms having single, larger fluid channels in each of the arms.

In operation, when pump/motor 190 is coupled to the drive train of a vehicle, high-pressure fluid is introduced to the yoke via port 175 (see FIG. 2) and travels up the arm 155 to the back plate 152 via channels 173. The high-pressure fluid is supplied to the valve plate 178 and to the barrel 158 via fluid cavities 177. The yoke 150 is sealed within a casing 192 (see FIG. 5A). Space within the casing 192 around the yoke 150 may be filled with hydraulic fluid, and coupled to a low-pressure fluid source, such as an accumulator, via a high volume, low loss fluid connection such as a large-bore pressure hose (not shown).

While fluid pressure within the cavities 177 is greater than, or equal to fluid pressure outside of the yoke 150, the poppet 168 of the check valve 160 remains in a closed position. Accordingly, operation in a forward mode is unaffected by the check valve 160. High-pressure fluid enters the cylinders 180 of the barrel 158 from the fluid cavities 177, driving pistons (not shown) downward, and causing the drive plate (not shown) to rotate, as described with reference to the pump/motor 102 of FIG. 1. The drive plate is connected to the barrel 158 via a flexible shaft means (not shown) and rotates the barrel 158 in unison. As the barrel 158 continues to rotate, fluid from the cylinders 180 is released into fluid cavities 176 at low pressure, whence it is returned to the low-pressure accumulator, via the channels 172 and the trunnion port 174.

To slow the vehicle, the fluid pressure connections at trunnion ports 175, 174 are reversed, as described in more detail hereafter, such that the high-pressure fluid source, a high-pressure accumulator, for example, is coupled to trunnion port 174, while the low-pressure fluid source is coupled to trunnion port 175. In this configuration, low-pressure fluid is drawn into the cylinders 180 of the barrel 158 via the fluid cavities 177, and pumped at high pressure from the cylinders 180 into the fluid cavities 176, and thence to the high-pressure accumulator via the trunnion port 174.

When the pump/motor is operating in pump mode, as occurs during a braking operation, fluid pressure within the fluid cavities 177 drops below the fluid pressure at the low-pressure accumulator. In known systems, such as that described with reference to FIG. 1, the pump/motor must develop enough suction to draw fluid through the valves and channels of the pump/motor, as previously described, which consumes energy. However, in the embodiment illustrated in FIG. 3, as soon as the pressure within the fluid cavities 177 drops below the pressure of the fluid within the casing 192 around the yoke 150, the poppet valve 168 opens, permitting fluid to pass directly from the space around the yoke 150 into the fluid cavities 177. In this way, low-pressure fluid is permitted to enter the pump/motor directly at the back plate 152, without the need to pass through the valves and passages of the pump/motor. Accordingly, the pressure losses previously encountered are substantially eliminated. As previously explained, the casing is provided with a high-volume, low-loss coupling to the low-pressure accumulator, which minimizes pressure losses. FIG. 3B shows a detail of a check valve 160 similar to that shown in FIG. 3A. The check valve 160 of FIG. 3B is shown in an open position, as described above. It may be seen, with reference to FIG. 3B, that when the poppet 168 is in the open position, fluid may pass freely around the poppet and into the fluid cavities 177.

While not shown, it will be understood that if the back plate 152 is provided with check valves on the opposite side, that is, between the fluid cavities 176 and the exterior of the yoke 150, regenerative braking may be carried out while the vehicle is traveling in reverse.

According to an alternate embodiment, the check valves may be configured to remain open under reverse pressures greater than the pressure found in the low-pressure side of the circuit, but to close under pressures much lower than the pressure present in the high-pressure side (spring biased open). In this way, low-pressure fluid may flow in either direction through the check valves, thus further reducing losses by generally bypassing most of the restrictive passages between the back plate of the pump/motor and the low-pressure fluid source, for example on the motor discharge side. On the other hand the valves will close instantly when high pressure is present in the corresponding fluid cavity. High pressure fluid must enter or exit the yoke.

Referring again to FIG. 1, it may be seen that in the prior art, fluid traversing the trunnions 120, 121 must execute several sharp turns in entering or leaving the pump/motor 102. For example, fluid entering via trunnion port 135 makes a sharp turn to pass axially through the trunnion 121 and through the bearing 127, and then another sharp turn to rise into the channel 129 of the arm 133. The fluid returning from the pump/motor must pass through a similar series of turns as it exits the trunnion 120. These sharp turns are due in large measure to the need for the trunnions 120, 121 to be of a length sufficient to pass through the bearings 126, 127, and to mate with fluid ports 136, 137 on the outside of the pump/motor casing 125.

FIG. 4 shows the pump/motor 190 according to an embodiment of the invention. FIG. 5A shows a cross-section of the pump/motor 190 of FIG. 4, taken along line 5-5.

Referring now to FIG. 5A, it may be seen that, according to an embodiment of the invention, in place of full bearings, such as the bearings 126, 127 of FIG. 1, partial bearings 196, 197 are shown, which occupy only an upper portion of a region of the respective trunnion 156, 157. While not limiting the invention in anyway, applicant believes that in operation, only an upper portion of a trunnion bearing is subjected to force of any significance, inasmuch as the net effect of all the forces exerted by the pump/motor is to push the yoke and trunnion away from the motor casing in an upward direction, as viewed in FIGS. 1 or 2. Consequently, the lower part of the trunnion bearing receives virtually no force or pressure.

Trunnion ports 174, 175 are located in positions occupied, in pump/motors of known art, by the lower portion of the trunnion bearings. For example, trunnion port 174 is shown exiting trunnion 156 between vertical planes that also define the horizontal limits of trunnion bearing 196. Fluid seals 200, 201 are positioned on either side of the trunnion bearings 196, 197 and trunnion ports 174, 175 of trunnions 156, 157, respectively.

The cross-section of FIG. 5A shows the yoke 150 and cylinder barrel 158 of FIG. 2, and provides a cross-sectional view of the trunnions 156, 157. Trunnion ports 174, 175 are shown coupled to fluid ports 182, 183 of the pump/motor casing 192. It may be seen that the fluid channels 172, 173 are much straighter as compared to those of a conventional pump/motor such as pump/motor 102 of FIG. 1, inasmuch as the trunnion ports 174, 175 can now be positioned in a location that, in the pump/motor of FIG. 1, is occupied by the lower half of bearings 126, 127. By straightening out the fluid channels 172, 173, and eliminating the sharp right-angle turns found in the passages 128, 129 of the pump/motor 102 of FIG. 1, fluid resistance is greatly reduced. This reduction in resistance in fluid passages 128, 129 results in a reduced pressure drop through these channels, which in turn results in a greater pressure differential available at the valve plate of the barrel 158, producing a greater availability of power, and improved efficiency of the pump/motor 190.

Additionally, because the trunnion ports 174, 175 are positioned closer to the center of the pump/motor, the trunnions 156, 157 may be made shorter than previously known trunnions, such as trunnions 120, 121 of FIG. 1, reducing the size and mass of the pump/motor 190 as compared to previously known pump/motors.

Because of the tremendous forces exerted on the trunnions 156, 157 when the pump/motor 190 is in operation, the arms 154, 155 and the trunnions 156, 157 undergo a distortion, with each of the arms 154, 155 tending to pivot upward and outward on the fulcrums formed by the bearings 196, 197. As a result, not only are the forces concentrated on the upper portions of the bearings 196, 197, but the forces are concentrated in a small area of the top of each bearing along an inner rim closest to the respective arm 154, 155. According to various embodiments of the invention, several bearing configurations are provided to improve efficiency and reduce wear on the trunnions 156, 157 and bearings 196, 197.

FIGS. 5B-5D illustrate three of the bearing configurations provided in accordance with various embodiments of the invention. In each of the FIGS. 5B-5D, a sectional detail of the trunnion 157 is shown, together with a portion of the pump/motor casing 192 and trunnion end cap 205. It will be understood that, while trunnion bearings configured to operate with trunnion 157 are shown, corresponding bearings are also provided to operate with trunnion 156, which are substantially identical, and so need not be illustrated separately.

FIG. 5B shows trunnion bearing 197. Bearing 197 is a roller bearing comprising a cage frame 203 and a plurality of needle rollers 215.

FIG. 5C shows a conical bushing 207. Bushing 207 is in the form of a section of a hollow cone. The bushing 207 tapers in thickness from an outboard edge 211 to an inboard edge 213, as may be seen by phantom lines T, which indicate the tapering thickness of the bushing 207. In operation, the bushing 207 is positioned on the trunnion 157 such that the inboard edge 213 is closest to the arm 155. Because of the taper of the bushing 207, when the pump 190 is idle, the upper surface closest to the inboard edge 213 does not contact the corresponding inner surface of the pump casing 192. However, when the pump 190 is in operation, the forces within the pump cause the arm 155 to deform slightly, flexing outward. As a result, the trunnion 157 is biased in a clockwise direction, as viewed in FIG. 5C, bringing the entire surface of the bushing 207 into contact with the inner surface of the pump casing 192, effectively distributing the load across the surface of the bushing 207, thereby reducing localized wear. The bushing 207 may be formed of bronze or some other suitable material, and may be impregnated with a lubricant.

FIG. 5D illustrates a cylindrical bushing 209. In addition to having a cylindrical cross-section in a first axis C, in order to accommodate the cylindrical shape of the trunnion 157, bushing 209 also has a cylindrical cross-section in a second axis D, as may be clearly seen in the sectional view of FIG. 5D. This shape permits the bushing 209 to adjust slightly within the space provided for it in the trunnion 157 of FIG. 5D as the varying forces placed on the trunnion 157 cause it to rotate slightly on the second axis D within the pump/motor casing 192. In this way, the stresses can be evenly distributed across the upper and lower surfaces of the bushing 209, preventing localized wear and stress. As with the bushing 207 of FIG. 5C, the bushing 209 may be formed of bronze or some other suitable material, and may be impregnated with an appropriate lubricant.

Currently known pump/motors employ couplings and hoses to carry high- and low-pressure fluid between the pump/motor and control valves located externally to the pump/motor. As has been previously explained, each time the fluid in a hydraulic circuit passes through a restriction in the passage or is required to make a sharp turn, there is an associated energy cost. Additionally, there is a pressure drop associated with any fluid channel. This "line loss" varies in direct proportion to the length of the channel.

FIG. 6 is a cross-sectional view of the pump/motor 190 taken along line 6-6 of FIG. 4. Referring to FIG. 4, a fluid supply channel 198 may be seen as it curves up toward the trunnion cover plate 204. The fluid supply channels 198, 199 are integrated into the structure of the pump/motor frame, eliminating the need for an external hose in this location. Referring to FIG. 6, the fluid supply channels 198, 199 may be clearly seen, positioned to carry fluid to and from the yoke 150 via spool valve 210. It may be seen, with reference to FIGS. 4 and 6, that the fluid supply channels 198, 199 are configured to provide passage for hydraulic fluid, while avoiding sharp turns and tight restrictions, wherever possible. Additionally, a spool valve 210 is integrated into the pump/motor frame. Because high- and low-pressure switching is accomplished by the spool valve 210, couplings and transmission lines between exterior switching valves and the pump/motor 190 are eliminated. Furthermore, by combining the function of the two valves 142, 143 of FIG. 1 into a single valve 210 of FIG. 6, complexity is reduced, and durability and safety are improved.

The structure and operation of a spool valve similar to that illustrated with reference to FIG. 6 is described in more detail in U.S. patent application Ser. No. 10/731,985, which is incorporated herein by reference, in its entirety.

Other valves may also be incorporated into the structure of the pump/motor 190, such as pilot valves, check valves, and actuator valves. For example, generally referring to FIGS. 6 and 5A, an actuator 218 controls the rotation of the yoke 150 on trunnions 156, 157. The actuator 218 is controlled by actuator control valve 216, which may be incorporated into the structure of the pump/motor 190. A detailed description of the operation of an actuator and actuator control valve of the type referenced in FIG. 6 may be found in U.S. patent application Ser. No. 10/767,547, which is incorporated herein by reference, in its entirety.

The pump/motor 190 of FIG. 6 also includes pressure input ports 212, 214, configured to receive a high-pressure fluid supply and a low-pressure fluid supply, respectively.

By incorporating the housings for the associated valves in the body or casing of the pump/motor, fluid channels formed within the casing can be routed directly to the valves with a minimum of obstruction and without passage through couplings or hoses. Additionally, because the channels are machined, or otherwise formed in the steel casing of the pump/motor, they do not have even the minimal resiliency associated with flexible pressure lines, thereby eliminating another source of energy loss.

Channels formed within the pump/motor casing are almost always shorter than equivalent channels formed using hoses, since a hose channel is required to follow a longer path around the pump/motor. The pressure loss is reduced over known systems and, additionally, the number of components of the pump/motor is reduced. It is known that, in hydraulic systems in general, hoses and hose connections are among the most frequent sources of failure and down time. Thus, by eliminating such from the system, the overall durability and dependability of the system is improved.

In known systems, such as that previously described with reference to FIG. 1, a first valve 142 is used to couple the fluid supply line 144 alternately to the high- or low-pressure fluid source, while a second valve 143 is used to perform the same function for the fluid supply line 145. Such an arrangement required that the valves 142, 143 be carefully coordinated in their operation. Otherwise, while reversing the sources of each of the valves 143, 145, there is a potential for a period during which both fluid supply lines 144, 145 may be connected to the high-pressure source 140 or to the low-pressure fluid source 138, simultaneously. While such a configuration does not damage the pump/motor 102, there is no energy transfer during this period. Thus, if a rapid switch is required, undesirable delays may occur. Additionally, high-pressure fluid on both sides of the pump/motor 102 results in unnecessary drag and wear on the motor.

By incorporating the valves into a single valve with multiple ports configured to control a coupling of both fluid supply lines with both the high- and low-pressure fluid sources, such as through spool valve 210 of FIG. 6, the coordination of the switching is improved, while the circuitry required to control the switching is simplified. If pressure losses in the high- or low-pressure sides of the hydraulic circuit of the pump/motor are reduced, the pressure differential at the valve plate of the pump/motor will be closer to that between the high- and low-pressure fluid sources. This will result in an increase in available power as well as improved fuel economy for an associated vehicle.

Additionally, if losses on the low-pressure side of the pump/motor circuit are reduced through the employment of one or more of the improvements described herein, the maximum pressure required in the low-pressure side of the circuit to overcome those losses may also be reduced. This makes possible the reduction of the overall pressure in the low-pressure accumulator, resulting in a further increase in the pressure differential at the motor, with a concomitant increase in available power to the motor.

Finally, if the maximum pressure in the low-pressure side of the circuit is reduced, the pressure within the pump/motor casing will also be reduced. With lower pressure in the pump/motor casing, the casing may be manufactured to lower pressure tolerances. Additionally, the low-pressure accumulator may also be manufactured to lower pressure tolerances. This allows a reduction in mass and weight of the casing and accumulator, which further increases the operational economy of the pump/motor while reducing its overall size, without reducing its power output.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A bent axis pump/motor, comprising:

a casing configured to be substantially filled with fluid;

a back plate positioned within the casing; and a check valve positioned in the back-plate and configured to permit passage of fluid from within the casing and outside of the back plate through the check valve to an interior of the back plate, and further configured to restrict flow of fluid from the interior of the back plate through the check valve.

2. The pump/motor of claim 1, further comprising a first pressurized fluid source pressurized at a first selected pressure, the first source in fluid communication with the casing such that fluid in the casing is substantially at the first selected pressure.

3. The pump/motor of claim 2, further comprising a second pressurized fluid source pressurized at a second selected pressure, higher than the first selected pressure.

4. The pump/motor of claim 1 wherein the interior of the back plate comprises first and second volumes configured to be differentially pressurized, and wherein the check valve is positioned between the exterior of the back plate and the first volume, the pump/motor further comprising an additional check valve also positioned between the exterior of the back plate and the first volume.

5. The pump/motor of claim 1 wherein the interior of the back plate comprises first and second volumes configured to be differentially pressurized, and wherein the check valve is positioned between the exterior of the back plate and the first volume, the pump/motor further comprising an additional check valve positioned between the exterior of the back plate and the second volume.

6. The pump/motor of claim 1 wherein the check valve is configured to close when pressure within the back plate meets or exceeds pressure outside the back plate.

7. The pump/motor of claim 1 wherein the check valve is configured to close when pressure within the back plate exceeds pressure outside the back plate by a selected value, greater than zero.

8. The pump/motor of claim 1 wherein the casing includes first and second apertures positioned coaxially on opposite sides of the casing and traversing from the interior of the casing to the exterior thereof, the pump/motor further comprising:

a yoke coupled to the back plate and having first and second trunnions positioned within the first and second apertures, respectively, the yoke configured to rotate on the trunnions around an axis;

first and second bearings positioned between the first and second trunnions and an inner wall of each of the first and second apertures, respectively, the position of each of the first and second bearings being further defined by respective inner and outer planes for each bearing, parallel to each other and transverse to the axis, with the respective bearing positioned therebetween, each of the first and second bearings occupying less than the complete circumference of the respective trunnion; and third and fourth apertures, the third aperture providing an opening in the first trunnion for passage of fluid therethrough, and positioned between the inner and outer planes for the first bearing thereof, and the fourth aperture providing an opening in the second trunnion for passage of fluid therethrough, and positioned between the inner and outer planes for the second bearing thereof.

9. The pump/motor of claim 8, further comprising:

first and second fluid supply channels formed integrally with the casing and configured to transmit fluid from fluid switching means to the first and second trunnions, respectively; and fifth and sixth apertures opening into the first and second apertures of the casing, respectively, and configured to couple the third and fourth apertures with the first and second fluid supply channels, respectively, for passage of fluid from the casing to the first and second trunnions.

10. The pump/motor of claim 9, further comprising a valve positioned within the casing and configured to selectively couple high- and low-pressure fluid supplies to the first and second trunnions via the first and second fluid supply channels.

11. A pump/motor, comprising:

a yoke configured to carry a rotatable barrel;

a trunnion rigidly coupled to the yoke and configured to be received by an aperture of a pump casing;

a bearing positioned on the trunnion so as to be between the trunnion and a wall of the aperture in a position defined by two parallel planes transverse to an axis of the trunnion; and a fluid channel passing within the yoke to the trunnion and exiting the trunnion via an aperture positioned between the two planes.

12. The pump/motor of claim 11, further comprising a pump casing having an aperture for receiving the trunnion.

13. The pump/motor of claim 11 wherein the bearing does not completely encircle the trunnion.

14. The pump/motor of claim 13 wherein the bearing has a shape of a section of a cone.

15. The pump/motor of claim 13 wherein the bearing has a shape of a section of a cylinder.

16. The pump/motor of claim 13 wherein the bearing is formed of a bronze alloy.

17. The pump/motor of claim 13 wherein the bearing is impregnated with lubricant.

18. The pump/motor of claim 13 wherein the bearing comprises a cage frame configured to receive needle rollers, and a plurality of needle rollers coupled to the frame.

19. A bent axis pump/motor, comprising:

a casing configured to receive components of the bent axis pump/motor;

a valve configured to selectively control fluid flow, the valve including a valve body, integral to the casing; and a first fluid channel, integral to the casing, having a first terminus at the valve and a second terminus at a first fluid port configured to transmit fluid to a first trunnion of the pump/motor.

20. The pump/motor of claim 19 wherein the valve is configured to selectively couple the first fluid channel with high- and low-pressure fluid sources.

21. The pump/motor of claim 19, further comprising a second fluid channel, integral to the casing, having a first terminus at the valve and a second terminus at a second fluid port configured to transmit fluid to a second trunnion of the pump/motor.

22. A hydraulic device, comprising:

a back plate having first and second volumes configured to be differentially pressurized;

means for admitting fluid directly from a region surrounding the back plate to the first volume; and means for controlling a flow of fluid from the first volume to the region surrounding the back plate.

23. The device of claim 22 wherein the controlling means includes means for preventing fluid from flowing from the first volume to the region surrounding the back plate.

24. The device of claim 22 wherein the controlling means includes means for preventing fluid pressurized at a pressure above a selected pressure from flowing from the first volume to the region surrounding the back plate.

25. The device of claim 22, further comprising means for admitting fluid directly from a region surrounding the back plate to the second volume.

26. A hydraulic device, comprising:

a yoke having first and second coaxial trunnions, the yoke configured to rotate around the common axis of the first and second trunnions;

a first bearing occupying less than a complete circumference of the first trunnion; and a first trunnion aperture occupying a portion of the circumference of the first trunnion not occupied by the first bearing.

27. The device of claim 26, further comprising a second bearing occupying less than a complete circumference of the second trunnion, and a second trunnion aperture occupying a portion of the circumference of the second trunnion not occupied by the second bearing.

28. A method of operating a pump/motor, comprising:

coupling a first fluid source to a first volume within a back plate of the pump/motor while coupling a second fluid source to a second volume within the back plate, such that an output shaft of the pump/motor is compelled to rotate in a first direction against an inertial load;

while the output shaft is rotating in the first direction, coupling the second fluid source to the first volume and coupling the first fluid source to the second volume, such that rotational force is applied to the output shaft in a second direction, in opposition to the rotation of the shaft; and drawing fluid into the first volume from a quantity of fluid immediately surrounding the back plate.

29. The method of claim 28 wherein the first fluid source is pressurized at a first pressure, the second fluid source is pressurized at a second pressure, lower than the first pressure, and the quantity of fluid is pressurized at a level substantially equal to the second pressure.

30. A pump/motor, comprising:

a casing;

a yoke positioned within the casing and configured to carry a rotatable barrel;

a bearing; and a trunnion coupled to the yoke and having an axis around which the yoke is configured to rotate with respect to the casing, and the bearing being positioned between the trunnion and the casing without completely encircling the trunnion.

31. The pump/motor of claim 30, further comprising a fluid channel passing through the trunnion to the yoke, the trunnion having a fluid aperture positioned between two parallel planes lying transverse to the axis of the trunnion and on either side of the bearing.

32. The pump/motor of claim 31 wherein the fluid aperture is positioned to transmit fluid between the trunnion and a fluid channel of the pump casing.

* * * * *